United States Patent [19]

Mullay et al.

[11] Patent Number: 5,051,142

[45] Date of Patent: Sep. 24, 1991

[54] EMULSION EXPLOSIVE CONTAINING NITROSTARCH

[75] Inventors: John J. Mullay, Hazleton; Joseph A. Sohara, Walnutport, both of Pa.; Dennis J. Schulz, Sandy, Utah

[73] Assignee: Atlas Powder Company, Dallas, Tex.

[21] Appl. No.: 466,222

[22] Filed: Jan. 17, 1990

[51] Int. Cl.[5] ..... C06G 45/00

[52] U.S. Cl. ..... 149/2; 149/62; 149/78; 149/108

[58] Field of Search ..... 149/2, 62, 108, 78

[56] References Cited

U.S. PATENT DOCUMENTS

| | | | |
|---|---|---|---|
| 2,461,582 | 2/1949 | Wright et al. | 260/467 |
| 2,485,855 | 10/1949 | Blomquist et al. | 260/467 |
| 2,678,946 | 5/1954 | Blomquist et al. | 260/467 |
| 3,423,256 | 1/1969 | Griffith | 149/2 |
| 3,711,345 | 1/1973 | Tomic | 149/22 |
| 3,899,374 | 8/1975 | Sylkhouse | 149/2 |
| 4,352,699 | 10/1982 | Zeigler, Jr. | 149/109.6 |
| 4,371,408 | 2/1983 | Fillman | 149/21 |
| 4,381,958 | 5/1983 | Howard | 149/19.8 |
| 4,383,873 | 5/1983 | Wade et al. | 149/2 |
| 4,450,110 | 5/1984 | Simmons et al. | 260/349 |
| 4,457,791 | 7/1984 | Gill et al. | 149/19.3 |
| 4,522,756 | 6/1985 | Schack et al. | 260/349 |
| 4,523,967 | 6/1985 | Cartwright | 149/2 |
| 4,664,729 | 5/1987 | Rehman | 149/21 |
| 4,726,919 | 2/1988 | Kristofferson et al. | 264/33 |
| 4,761,250 | 8/1988 | Frankel et al. | 260/349 |
| 4,853,157 | 8/1984 | Stiff | 558/483 |

FOREIGN PATENT DOCUMENTS 0129995 2/1985 European Pat. Off. .

OTHER PUBLICATIONS

U.S. Statutory Invention Registration No. H448 to Farncomb et al., published Mar. 1, 1988, filed Jul. 6, 1988.

"Zeitschrift fur das gesamte Schiefb und Sprengstoffwesen", *Investigation of Extraction and Characteristics of Nitrostarches*, (and English translation thereof) by J. Hackel and T. Urbanski, Warsaw, Poland, Oct. 1933, Issue Nos. 10, 11, 12.

*Primary Examiner*—Stephen J. Lechert, Jr.
*Attorney, Agent, or Firm*—Richards, Medlock & Andrews

[57] ABSTRACT

Emulsion explosive compositions comprising a discontinuous aqueous oxidizer salt phase and a continuous carbonaceous fuel phase and from about 5% to about 50% nitrostarch are disclosed which exhibit increased resistance to precompression or dead pressing while maintaining high detonation velocities.

25 Claims, No Drawings

EMULSION EXPLOSIVE CONTAINING NITROSTARCH

TECHNICAL FIELD

This invention relates to water-in-oil and melt-in-fuel explosive compositions and more particularly to water-in-oil emulsions and melt-in-fuel explosives containing nitrostarch to produce a high detonation velocity explosive composition which resists precompression while maintaining acceptable explosive properties.

BACKGROUND OF THE INVENTION

Water-in-oil emulsion type blasting agents are well-known in the art as first disclosed by Bluhm in U.S. Pat. No. 3,447,978. Water-in-oil emulsion explosives have many advantages over conventional slurry blasting compositions dynamites, ANFO, and aqueous gelled explosives, as they significantly enhance detonation velocities. The emulsion explosive compositions of Bluhm now in common use in the industry typically have the following components: (a) a discontinuous aqueous phase comprising discrete droplets of an aqueous solution of inorganic, oxygen-releasing salts; (b) a continuous water-immiscible organic phase through which the droplets are dispersed; (c) an emulsifier which forms an emulsion of the droplets of oxidizer salt solution throughout the continuous organic phase; and (d) a discontinuous gaseous phase.

Water-in-oil emulsion explosive compositions require uniformly dispersed void spaces provided by gas bubbles or a void-providing agent to obtain explosive performance. Therefore, maintaining the uniformly dispersed void spaces in the water-in-oil emulsion explosive is important in achieving good detonation performance and good shelf life. Furthermore, the manner in which void spaces are treated may affect the explosive properties of the emulsion explosive.

Void spaces can be provided by gas bubbles which are mechanically or physically mixed or blown into an emulsion explosive. Voids can also be formed in an emulsion explosive by a chemical gassing agent, or mixed into an emulsion explosive by a void-providing agent such as hollow microspheres, expanded perlite or styrofoam beads.

A disadvantage of air or gas bubbles results from the fact that they are compressible under high pressure. If subjected to high pressure and compressed, the overall density of the emulsion explosive composition is increased and the composition is no longer detonable (i.e. will not detonate reliably using a No. 8 blasting cap) and explosive performance is reduced. The above phenomenon of density increase and desensitization of an explosive composition is known as precompression or dead pressing. Water-in-oil emulsion explosive compositions utilizing hollow microspheres of resin or glass can withstand higher pressures than gas or air bubbles, but they too have a critical point of pressure at which they collapse and density reduction takes place.

Emulsion explosive compositions employing hollow microspheres or gas or air bubbles are particularly vulnerable to dead pressing in large blasting applications where holes in a blast pattern are detonated at varying time sequences. An undetonated borehole loaded with an emulsion explosive composition with hollow microspheres can experience dead pressing as a result of a desensitizing shockwave from an adjacent previously fired borehole. The impact of the adjacent charge compresses the undetonated charge, thus increasing its density to the point where it becomes undetonable.

To overcome the above phenomenon, it has been suggested that one should use stronger hollow microspheres which can withstand greater hydrostatic pressures and thus remain detonable. This suggested solution is both costly and can cause emulsion breakdown problems.

In addition, it is important for an explosive to detonate at a high velocity of detonation. This is especially important in presplitting applications used in road and building construction where high velocity detonation is useful to effect the splitting of rock between boreholes rather than crushing and pulverizing the rock. Such high velocity detonation explosives allow for better performance in rock breakage as well as making the explosive useful as a primer charge for less sensitive (blasting agent) energetic materials. Consequently, it is a goal of explosive manufacturers to provide a product that detonates at the highest detonation velocity possible. Thus, there exists a continuing need in the industry to provide a small diameter high velocity emulsion explosive product which resists precompression while maintaining acceptable explosive properties which is economical and safer to manufacture than dynamite, yet provides the high velocity performance characteristics of dynamite.

SUMMARY OF THE INVENTION

The explosive emulsion composition of the present invention provides an emulsion composition which contains between about 5% to about 50% nitrostarch. Surprisingly, it has been found that the use of nitrostarch in the emulsion explosive of the present invention provides a significantly increased detonation velocity and also provides an improvement in the resistance of emulsion explosive products to precompression or dead pressing.

DETAILED DESCRIPTION OF THE INVENTION

The present invention provides a high velocity, precompression resistant water-in-oil emulsion explosive in small diameters. The present invention can provide small diameter explosives having a diameter of about 1 ¼ inches or less with a detonation velocity of about 5,000 meters per second or more. The nitrostarch used in the emulsion explosive of the present invention may be of any suitable type. Typically, nitrostarch is available in wetted powdered form which is then incorporated into the water-in-oil emulsion explosive composition of the present invention. Alternatively, nitrostarch may be placed in the emulsion pursuant to the process disclosed in U.S. Pat. No. 4,980,000, issued Dec. 25, 1990, entitled "Nitrostarch Emulsion Explosives Production Process".

The composition of the present invention can be formed by preparing a carbonaceous fuel phase of a water-immiscible carbonaceous fuel and an emulsifier which is effective to form a water-in-oil emulsion and an aqueous phase containing dissolved inorganic oxidizer salts. These two phases are then combined together to form an emulsion and void spaces are provided throughout the emulsion. The nitrostarch may be directly added to either the oxidizer or the fuel phase prior to the formation of the emulsion or, alternatively, the nitrostarch may be added after the emulsion has been formed. Additionally, the nitrostarch may be added in the same fashion in forming a melt-in-fuel emulsion explosive.

The preferred embodiment of the water-in-oil emulsion explosive composition of the present invention has the following general formula (all percentages herein are of total emulsion weight percents):

| Component | Weight Percent |
|---|---|
| Oxidizer salts (nitrates, perchlorates) | Greater than about 70% |
| Water | 0% to about 50% |
| Nitrostarch | 5% to about 50% |
| Sensitizers | 0% to about 40% |
| Auxiliary fuels, densifiers | 0% to about 50% |
| Density reducing agent sufficient to render the composition detonable | 0% to about 6% |
| Emulsifier | 0.1% to about 10% |

The emulsifier component useful in the practice of the present invention includes any emulsifier which is effective to form a water-in-oil emulsion. Emulsifiers effective to form water-in-oil emulsions are well-known in the art. Examples are disclosed in U.S. Pat. Nos. 3,447,978; 3,715,247; 3,765,964; and 4,141,767; the disclosures of which are hereby incorporated by reference. In addition, acceptable emulsifiers can be found in the reference work entitled McCutcheon's Emulsifiers and Detergents (McCutcheon Division, M.C. Publishing Co., New Jersey). As examples, the following are not to be interpreted as limiting. Specific emulsifiers that can be used include those derivable from sorbitol by esterification with removal of water. Such sorbitan emulsifying agents may include sorbitan fatty acid esters such as sorbitan monolaurate, sorbitan monooleate, sorbitan monopalmitate, sorbitan monostearate and sorbitan tristearate. The mono- and di-glycerides of fat-forming fatty acids are also useful as emulsifying agents. Other emulsifying agents which may be used in the present invention include polyoxyethylene sorbitol esters such as polyoxyethylene sorbitol beeswax derivative materials. Water-in-oil type emulsifying agents such as the isopropyl esters of lanolin fatty acids may also prove useful, as may mixtures of higher molecular weight alcohols and wax esters. Various other specific examples of water-in-oil type emulsifying agents include polyoxylene lauryl ether, polyoxyethylene oleyl ether, polyoxyethylene sterol ether, polyoxyoctylene, oleyl laureate, oleyl acid phosphates, substituted oxazolines and phosphate esters, to list but a few. Further, emulsifiers derivable from the esterification of monoor polyhydric aliphatic alcohols by reaction with olefin substituted succinic acids are useful in practice of the present invention. Also, emulsifiers derivable from the addition of polyalkylene amine to a polyalkylene-substituted succinic acid are also useful in the present invention, as well as are substituted saturated and unsaturated oxozalines. Mixtures of these various emulsifying agents as well as other emulsifying agents may also be used.

The liquid organic water-immiscible carbonaceous fuel is a fuel which is flowable to produce the continuous phase of an emulsion. The liquid organic carbonaceous fuel component can include most hydrocarbons. For example, paraffinic, olefinic, naphthenic, aromatic, and saturated or unsaturated hydrocarbons can be used. Suitable water-immiscible organic fuels include diesel fuel oil, mineral oil, kerosene and other petrochemical fuels, paraffinic waxes, microcrystalline waxes, and mixtures of oil and waxes. Preferably, the organic water-immiscible fuel is a light fuel oil such as mineral oil. Suitable oils useful in the compositions of the present invention include the various petroleum oils, vegetable oils, and mineral oils, e.g., a highly refined white mineral oil sold by White's Chemical Company, Inc. under trade designation KAYDOL ®, and the like. Waxes are preferably used in combination with oils, and generally, heating is required in order to dissolve the wax and oil together. Utilization of wax typically results in an emulsion which is more viscous than when mineral oil, diesel fuel oil or another light hydrocarbon oil is used. Suitable waxes such as petroleum wax, microcrystalline wax, paraffin wax, mineral waxes such as oxocerite and montan wax, animal waxes such as spermacetic wax, and insect waxes such as beeswax and Chinese wax can be used in accordance with the present invention.

Additionally, auxiliary fuels such as those known in the art, including finely divided coal, aluminum flakes, aluminum granules, ferrophosphorus, sugar, silicon, magnesium and sulfur can be incorporated. Generally, any of the auxiliary fuels known in the art can be used.

Preferably, the density of emulsion explosive is controlled by using density reducing agents. Most preferably the density is reduced using glass or resin microballoons. Typically, the density of the explosive composition should be from about 0.9 g/cc to 1.45 g/cc, and most preferably from about 1.0 g/cc to about 1.4 g/cc.

It is also possible, but not necessary, to include sensitizers in the emulsion explosive of the present invention. Sensitizers suitable for use with the present invention include monomethylamine nitrate, TNT, PETN, and others known in the art. Sensitizers may be employed to increase sensitivity to detonation but usually will not be added because they are expensive.

Additionally, emulsion detonability is enhanced by distributing therethrough substantially uniformly dispersed void spaces. Density reducing agents may be added to reduce density. The density may be reduced to the desired level by the addition of voids in the form of gas bubbles, density reducing agents or a combination of both. These density reducing agents also serve to sensitize the total composition. Any suitable density reducing agent may be used including those known in the art such as glass or resin microballoons, saran or resin microspheres, styrofoam beads, perlite, and expanded perlite. The density reducing agent can also be entrained gas bubbles or occluded gas generated in situ. Such gas bubbles are retained in the emulsion and may be generated either by whipping into the emulsion or by use of gassing agents such as thiourea together with sodium nitrite. The preferred density reducing agent utilized in the present invention is microballoons.

The discontinuous phase is composed of an emulsified aqueous inorganic oxidizer salt solution. Oxidizer salts suitable for use with the present invention may include those known in the art and also alkali metal and alkaline earth metal nitrates, and perchlorates such as ammonium nitrate, sodium nitrate, calcium nitrate and potassium nitrate. These oxidizer salts may also be utilized in combination.

The precompression resistance of the explosive compositions of the present invention were measured using a specialized laboratory scale method. In this test, a donor charge (a No. 8 cap and primer unit containing two grams of PETN) and a receiver cartridge ($1\frac{1}{4}'' \times 7''$ paper cartridge containing the test explosive material) were placed under water at a known distance from each other. The receiver cartridge was primed with a No. 8 blasting cap which was delayed 75 milliseconds from the donor cap. In several instances, the receiver cartridge was not detonated so that the cartridge could be retrieved and inspected. In most cases, however, initiation was attempted in the receiver cartridge. Detonation results were determined either by inspection or detonation velocity measurements or both. The smaller the distance between donor and receiver cartridges in which the receiver remains detonable, the more precompression resistant is the formula. This test is used because it allows the evaluation of many samples, appears to adequately represent field effects, and is reproducible.

The results contained in Tables I and II are intended to illustrate the effect of nitrostarch on both precompression resistance and detonation velocity. The following examples are given to better facilitate the understanding of the subject invention but are not intended to limit the scope thereof.

The same unsensitized emulsion matrix was used in each example. The sample emulsion was prepared in accordance with the procedures as presented in the known art. Specifically, the emulsion matrix was prepared utilizing a fuel mixture composed of 20 parts by weight of emulsifier and 80 parts by weight of fuel oil. The emulsifier utilized is a mixture consisting of sorbitan monooleate and a co-emulsifier formed by the addition of a polyalkyl amine to polyalkene substituted succinic acid. The fuel oil utilized was mineral oil. This fuel mixture was added with mixing to an oxidizer solution heated to about 100° C. and composed of 78.5 parts by weight of ammonium nitrate, 10.7 parts of sodium nitrate and 10.8 parts of water. Both the microballoons and the nitrostarch were poured into this emulsion matrix with stirring to provide homogeneity.

Examples I through XII in Table I illustrate the effect of using nitrostarch on the resistance of the emulsion to precompression. Examples I, V and IX represent control samples in which no nitrostarch was utilized, for use in comparison to the results obtained with the remaining examples listed in Table I, wherein varying amounts of nitrostarch were utilized. Three series are compared representing the use of three different types of microballoons. In each of Examples I–IV, Examples V–VIII, and Examples IX–XII, all three comparisons demonstrate that the use of nitrostarch significantly improves the performance of the emulsion explosive under precompression conditions.

The results presented in Table II indicate the effect of using nitrostarch on the detonation velocity of the explosive. Again, the emulsion matrix utilized in Examples I through XI of Table II was the same as that used in Examples I through XII of Table I. However, in Examples IV, V, and VI of Table II, varying amounts of FeP were added to the formulations of Examples I, II and III of Table II in order to increase the density of the product.

TABLE II

COMPARISON OF DETONATION VELOCITIES AND DETONATION PRESSURES FOR VARIOUS FORMULATIONS

| INGREDIENT | I | II | III | IV | V | VI |
|---|---|---|---|---|---|---|
| Emulsion Matrix | 99 | 69 | 99 | 69 | 98.25 | 78.25 |
| Nitrostarch[d] | 0 | 30 | 0 | 30 | 0 | 20 |
| B23/500[a] | 1 | 1 | — | — | — | — |
| Sil 32[b] | — | — | 1 | 1 | — | — |
| C15/250[a] | — | — | — | — | 1.75 | 1.75 |
| Density (g/cc) | 1.34 | 1.33 | 1.30 | 1.33 | 1.21 | 1.21 |
| Detonation Velocity (m/sec) | F | 7000 | F | 5640 | 4620 | 5440 |
| Detonation Pressure[c] (k bars) | 0 | 124 | 0 | 106 | 65 | 90 |

[a]Glass microballoons (3M Corp.)
[b]Hollow microspheres formed from volcanic ash (Silbrico Corp.)
[c]Calculated values obtained using the detonation velocity, density and the equation presented in the text.
[d]Amount of nitrostarch used is calculated on a 100% nitrostarch basis.

What is claimed is:

1. A water-in-oil emulsion explosive composition consisting essentially of from about 5% to about 50% nitrostarch based on weight of total composition.

2. The water-in-oil emulsion explosive composition of claim 1 wherein from about 45% to 90% by weight of the total composition is inorganic oxidizing salts, from about 1% to about 20% by weight of the total composition is carbonaceous fuels, including an emulsifier, and up to about 50% by weight of the total composition is water.

3. The explosive composition of claim 2 and further comprising density reducing agents.

4. The explosive composition of claim 3 wherein said density reducing agents comprise up to about 10% by weight of said emulsion explosive.

5. The explosive composition of claim 2 and further comprising sensitizers.

6. The explosive composition of claim 5 wherein said sensitizers comprise up to about 40% by weight of said emulsion explosive.

7. The explosive composition of claim 2 and further comprising auxiliary fuels.

TABLE I

COMPARISON OF PRECOMPRESSION RESULTS FOR VARIOUS FORMULATIONS

| INGREDIENT | I | II | III | IV | V | VI | VII | VIII | IX | X | XI | XII |
|---|---|---|---|---|---|---|---|---|---|---|---|---|
| Emulsion Matrix | 98.25 | 88.25 | 78.25 | 68.25 | 98.25 | 88.25 | 78.25 | 68.25 | 96.5 | 86.5 | 76.5 | 66.5 |
| Nitrostarch[d] | 0 | 10 | 20 | 30 | 0 | 10 | 20 | 30 | 0 | 10 | 20 | 30 |
| B23/500[a] | 1.75 | 1.75 | 1.75 | 1.75 | — | — | — | — | — | — | — | — |
| Sil 32[b] | — | — | — | — | 1.75 | 1.75 | 1.75 | 1.75 | — | — | — | — |
| C15/250 | — | — | — | — | — | — | — | — | 3.5 | 3.5 | 3.5 | 3.5 |
| Density (g/cc) | 1.26 | 1.28 | 1.30 | 1.29 | 1.24 | 1.25 | 1.26 | 1.27 | 1.05 | 1.05 | 1.07 | 1.09 |
| Precompression Test Result[c] | F/8 | 4480/8 | 3050/6 | 5860/6 | 3050/6 | 4760/6 | 5080/6 | 5080/6 | 4233/8 | 5443/6 | 5860/6 | 6350/6 |
| [Det Vel. (m/sec)/ distance (inches)] | | | | 5860/6 | 2025/5 | 2630/4 | 4233/4 | 4920/4 | F/6 | F/4 | F/4 | 5080/4 |

[a]Glass microballoons (3M Corp.)
[b]Hollow microspheres formed from volcanic ash (Silbrico Corp.)
[c]Precompression results are presented in terms of the velocity of detonation of the receiver charge and the distance of the donor from the receiver.
[d]Amount of nitrostarch used is calculated on a 100% nitrostarch basis.

8. The explosive composition of claim 7 wherein said auxiliary fuels comprise up to about 50% by weight of said emulsion explosive.

9. The explosive composition of claim 2 wherein said organic oxidizing salts are selected from the group consisting of alkali metal and alkaline earth metal nitrates and perchlorates.

10. The explosive composition of claim 2 wherein said carbonaceous fuel comprises water-immiscible emulsifiable material selected from the group consisting of petrolatum, microcrystalline, paraffin, mineral, animal and inert waxes, petroleum oils, vegetable oils and mixtures thereof.

11. A water-in-oil emulsion explosive composition consisting essentially of a discontinuous aqueous phase of an inorganic oxidizer salt solution;

a continuous carbonaceous fuel phase including an emulsifier;

about 5% to about 50% nitrostarch based upon weight of total composition to thereby reduce pre-compression of said explosive composition; and a density reducing agent.

12. The explosive composition of claim 11 wherein said inorganic oxidizing salts are more than about 70% by weight of said emulsion explosive.

13. The explosive composition of claim 12 wherein said inorganic oxidizing salts are selected from the group consisting of alkali metal and alkaline earth metal nitrates and perchlorates.

14. The explosive composition of claim 11 wherein the water contained in said discontinuous phase comprises up to about 50% by weight of said emulsion explosive.

15. The explosive composition of claim 11 wherein the continuous fuel phase comprises water-immiscible emulsifiable carbonaceous materials including an emulsifier comprising up to about 20% by weight of said emulsion explosive.

16. The explosive composition of claim 15 wherein the water-immiscible, emulsiviable carbonaceous materials in said continuous fuel phase are selected from the group consisting of petrolatum, microcrystalline, paraffin, mineral, animal and insect waxes, petroleum oils, vegetable oils and mixtures thereof.

17. The explosive composition of claim 15 wherein the emulsifier in said fuel phase comprises from about 0.1% to about 10% by weight of said emulsion explosive.

18. The explosive composition of claim 11 and further comprising density reducing agents.

19. The explosive composition of claim 18 wherein said density reducing agents are present in sufficient amount to obtain a density of from about 0.9 g/cc to about 1.45 g/cc for the total composition.

20. The explosive composition of claim 18 wherein said density reducing agents comprise up to about 10% by weight of said emulsion explosive composition.

21. The explosive composition of claim 11 and further comprising sensitizers.

22. The explosive composition of claim 21 wherein said sensitizers comprise up to about 40% by weight of said emulsion explosive.

23. The explosive composition of claim 22 wherein said auxiliary fuels comprise up to 50% by weight of said emulsion explosive.

24. The explosive composition of claim 2 and further comprising densifiers.

25. The explosive composition of claim 11 and further comprising densifiers.

* * * * *

UNITED STATES PATENT AND TRADEMARK OFFICE

CERTIFICATE OF CORRECTION

PATENT NO. : 5,051,142

DATED : September 24, 1991

INVENTOR(S) : John J. Mullay et al.

It is certified that error appears in the above-identified patent and that said Letters Patent is hereby corrected as shown below:

Column 1, line 50, delete "i.e." and insert therefore --i.e.--.

Column 4, line 50, delete "in situ" and insert therefore --in situ--.

Column 8, line 5, delete "emulsiviable" and insert therefore --emulsifiable--.

Signed and Sealed this

Sixth Day of April, 1993

*Attest:*

STEPHEN G. KUNIN

*Attesting Officer*

*Acting Commissioner of Patents and Trademarks*